United States Patent [19]

Campana

[11] 3,996,110

[45] Dec. 7, 1976

[54] COKE OVEN LEVELER DOOR

[76] Inventor: Patsie Carmen Campana, 2614 Sherwood Drive, Lorain, Ohio 44053

[22] Filed: Sept. 16, 1975

[21] Appl. No.: 613,817

[52] U.S. Cl. ..... 202/248; 110/173 R; 202/269

[51] Int. Cl.[2] ..... C10B 25/02; C10B 25/16

[58] Field of Search ..... 202/248, 250, 269; 110/173 R; 49/485, 489; 34/242

[56] References Cited

UNITED STATES PATENTS

| | | | |
|---|---|---|---|
| 338,616 | 3/1886 | Roney | 110/173 R X |
| 1,432,591 | 10/1922 | Carll | 110/173 R X |
| 2,442,391 | 6/1948 | Wilputte | 202/248 |
| 2,606,865 | 8/1952 | Forsans | 202/248 |
| 3,032,483 | 5/1962 | Ackeren et al. | 202/248 |
| 3,567,590 | 3/1971 | Reinfeld et al. | 202/248 |
| 3,711,380 | 1/1973 | Teplitz | 202/248 |
| 3,881,995 | 5/1975 | White, Jr. | 202/248 |

FOREIGN PATENTS OR APPLICATIONS

| | | | |
|---|---|---|---|
| 906,091 | 7/1949 | Germany | 202/248 |
| 612,076 | 11/1948 | United Kingdom | 202/248 |

*Primary Examiner*—Morris O. Wolk
*Assistant Examiner*—Roger F. Phillips
*Attorney, Agent, or Firm*—Fay & Sharpe

[57] ABSTRACT

An improved coke oven leveler door which is constructed from a mild steel plate having substantially flat inner and outer faces with the inner face adapted to selectively close a leveler opening included in the coke oven main door. Support members are rigidly affixed to the outer face of the door and disposed to extend generally radially outward from the central portion of the outer face. Means are also included on the outer face for mounting the door in operative communication with biasing means to place a continuous biasing force against the door at least when it is in a closed position. The inner face of the door includes knife-edge like sealing means protruding outwardly therefrom for sealing the door when it is in a closed position. The configuration of the knife-edge sealing means is such to enhance leveler door sealing during a coking operation.

11 Claims, 8 Drawing Figures

COKE OVEN LEVELER DOOR

BACKGROUND OF THE INVENTION

This invention relates to a door construction and more particularly to a door construction which is exposed to high temperatures.

The invention is particularly applicable to use on a coke oven leveler door and will be described with particular reference thereto; however, it will be appreciated by those skilled in the art that the invention has broader applications and may be used in other environments where a door which is exposed to high temperatures must resist or be adapted to heat induced warpage which would otherwise prevent the door from properly sealing around a door frame.

Coke oven is a term of art employed for the large ovens which are used to produce coke and coke by-products from coal. While there are a number of types and styles of coke ovens, they typically have a substantial vertical height and depth in relation to the width and, in some respects, resemble a very large closet. In many instances, the heighth of these ovens is well over 10 feet and virtually the entire front face of the oven may be selectively opened and closed by means of a coke oven door. Normally, a plurality of the individual ovens are located in a side by side relationship to form what is commonly termed an oven battery in order that a high volume of coke and coke by-products may be made at one location.

In the type of oven described above, charging of the oven prior to the coking operation is done from the top thereof and the coke oven door itself includes a leveler or chuck hole opening adjacent the uppermost vertical portion thereof. A leveler door is disposed adjacent the leveler opening and is selectively movable between opened and closed positions for allowing access to the inside of the oven. This leveler opening finds its principal use in receiving a leveler bar which is reciprocated or raked across the peaked coal piles charged into the furnace in order to level them prior to beginning an actual coking operation.

In prior coke ovens, the coke oven doors and leveling doors have been constructed from cast iron since it was thought to be the best means in which to avoid undesired door warpage during coking operations. Warpage is a significant problem due to the high temperatures, e.g., 2000° F and above, acting on the inside faces of the doors during a coking operation. When warpage occurs, the original close fitting or sealing relationship between the coke oven and leveler doors is distributed so that there is heat and pollution loss from the oven as well as air admission into the oven. Such circumstances are undesirable from both environmental and overall operational points of view. While prior doors have variously utilized special sealing structures, such structures have not eliminated the sealing problems when warpage occurs. The primary problem with the prior cast iron oven and leveler doors has been diagnosed as a failure of the doors to warp evenly with each other when they are subjected to the elevated temperatures of a coking operation. This difference in warpage may be attributed to the significant difference in door surface areas as well as the fact that the entire leveler door, because of its location in the oven door adjacent the uppermost portion of the oven itself, is subjected to the highest temperature developed in the oven. Thus, the two doors will warp in varying degrees so that the outer edges of the leveler door will not closely mate with the leveler door opening.

The subject invention is directed toward an improved construction for a coke oven leveler door which overcomes the above discussed problems and provides an improved leveler door structure which is simple to manufacture, readily adapted to use on virtually all types of leveler doors used on different types and styles of coke ovens, and provides a structure which facilitates continuous sealing around the periphery of the leveler door during coking operations.

BRIEF DESCRIPTION OF THE PRESENT INVENTION

In accordance with the present invention, there is provided an improved leveler door construction for coke ovens of the type having a coke oven door for providing access to the inside of the oven and wherein the oven door includes a leveler opening which may be selectively opened and closed by a leveler door which is mounted in close spaced proximity thereto. The improved leveler door is constructed from a mild steel plate having substantially flat inner and outer faces with the inner face covering the leveler opening when the leveler door is in the closed position. Support members are rigidly mounted to the outer face and disposed to extend radially outward from the central portion of that face. Means on the outer face are provided for mounting the leveler door in operative communication with biasing means which exert a continuous biasing force against the outside of the leveler door when it is in the closed position. Sealing means are included on the leveler door inner face adjacent the outer periphery thereof for sealing the leveler opening when the leveler door is in the closed position.

In accordance with a more limited aspect of the present invention, the support members comprise gussets which decrease in thickness therealong from the central portion of the leveler door outer face toward the outer periphery thereof. The gusset members are rigidly affixed to the outer face by means of intermittent welds spaced longitudinally therealong.

In accordance with a further limited aspect of the present invention, the sealing means is disposed generally peripherally around the outer edge of the inner face and comprises a generally knife-edge like seal extending outwardly from the inner face. The seal is spaced from the inner face and retained in position by seal retaining means rigidly affixed to the inner face.

In accordance with still another aspect of the present invention, the knife-edge like seal is mounted to enhance leveler door sealing during a coking operation.

The principal object of the present invention is to provide an improved coke oven leveler door construction which will retain a seal around an associated leveler door opening during coking operations.

Another object of the present invention is the provision of an improved leveler door which is easy to manufacture.

Still another object of the present invention is the provision of an improved leveler door which will conform to a warped leveler door opening when they are exposed to the elevated temperatures encountered during coking operations.

A further object of the present invention is the provision of a leveler door which may be constructed from readily available and conventional materials.

Other objects of the invention will become apparent to those skilled in the art from a reading of the following specification and claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein.

DETAILED DESCRIPTION OF THE PREFERRED EMBODIMENT

Figure 1:
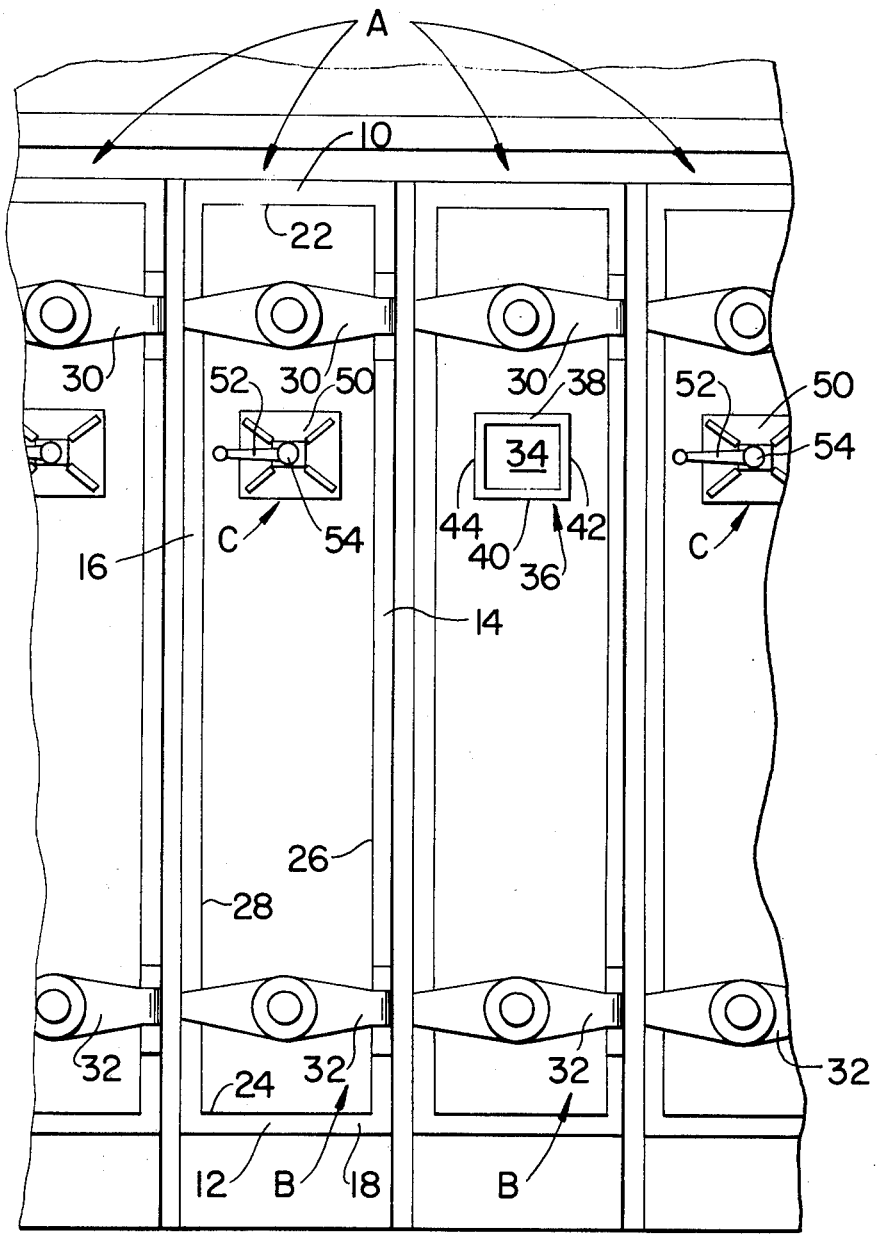
FIG. 1 is a front elevational view in partial schematic of several coke ovens comprising a portion of a coke oven battery wherein the general environment contemplated for using the subject invention is shown.

Referring now to the drawings wherein the showings are for purposes of illustrating the preferred embodiment of the invention only and not for purposes of limiting same, the FIGURES show a plurality of coke ovens generally designated A each having a coke oven door generally designated B with each coke oven door, in turn, including a leveler door generally designated C.

The coke ovens A themselves are identical to each other so description will hereinafter be generally made with regard to one such oven, it being understood that application of the invention is equally applicable to the other of the ovens shown in FIG. 1. Further, and while other coke oven designs other than the ones shown in FIG. 1 are known, the leveler door concepts disclosed hereinafter are deemed to be equally applicable to such other designs.

Each coke oven A includes an upper end 10, a lower end 12 and spaced apart vertical sides 14, 16. Extending between ends 10, 12 and sides 14, 16 is an outer end face generally designated 18. The oven itself has a front to rear depth which is not shown here inasmuch as it does not pertain to the subject invention but it should be noted that the oven is charged from upper end 10 along that depth. The oven has a much greater heighth and depth than width and generally looks like a much enlarged closet. The ovens themselves do not themselves form a part of the present invention so that a detailed description thereof is not deemed necessary.

In actuality, coke oven door B comprises a substantial portion of outer end face 18 and has an upper end 22, lower end 24 and spaced apart vertical sides 26, 28. The door is conveniently hinged or otherwise removably affixed to outer vertical end face 18. Included on the oven and door assemblies A and B is an upper locking mechanism 30 and a lower locking mechanism 32 for purposes of maintaining door B in a closed, sealed relationship with outer end face 18. Door B is primarily employed for purposes of removing the coke and coke by-products from the interior of the oven following a coking operation and otherwise normally remains closed and sealed.

Each coke oven door B includes an opening therein as generally designated 34 in FIG. 1. Opening 34 is only shown on one of the coke ovens A where the associated coke oven leveler door C has been removed for ease of illustration of the overall environment. As shown in the other of the coke ovens A in FIG. 1, leveler doors C normally cover opening 34 when the doors are in the closed position. In any event, disposed about opening 34 is a leveler door frame generally designated 36 having outwardly facing edges 38, 40, 42 and 44. As will be described in greater detail hereinafter, the associated leveler door C closely sealingly engages these outwardly facing edges.

The construction described hereinabove with reference to the general configuration of the coke ovens to which the subject invention is deemed particularly applicable is conventional. Inasmuch as this structure does not form a part of the present invention and is deemed known to those skilled in the art, further description thereof for the present purposes is deemed unnecessary.

Each leveler door C is comprised of a door construction generally designated 50 and which door construction is mounted to the associated coke oven door B by a convenient leveler door mounting assembly generally designated 52 in FIG. 1. Assembly 52 conventionally includes biasing means 54 normally comprising a very stiff spring means. This means exerts a continuous inward biasing force against the door when it is in its closed position to continuously urge it into the proper sealing engagement with the associated coke oven door. The leveler door mounting assemblies and biasing means themselves are deemed known in the art and do not, in and of themselves, comprise a part of the present invention.

With particular reference to FIGS. 2-5, description will hereinafter be made to the preferred arrangement for a leveler door 50. The door is shown as having generally flat outer face 56 and a generally flat inner face 58 with peripheral side edges 60, 62, 64 and 66. In the preferred embodiment, leveler door 50 is constructed from a mild cold rolled steel plate with faces 56, 58 being generally flat and parallel to each other. The preferred steel is mild steel having a carbon content not exceeding 0.20% because of its known property of thermal deformation under stress. This physical property should be contrasted with the general rigidity of cast iron under similar conditions. This difference becomes important during coking operation when temperatures act on inner face 58 as will be described hereinafter. Other mild steels having similar physical characteristics could also be employed without departing from the intent and scope of the invention. Typically, opening 34 is generally square or rectangular with door 50 having a substantially similar configuration with the intersection of edges 60, 62, 64 and 66 defining corner areas generally designated 68, 70, 72 and 74.

Figure 2:
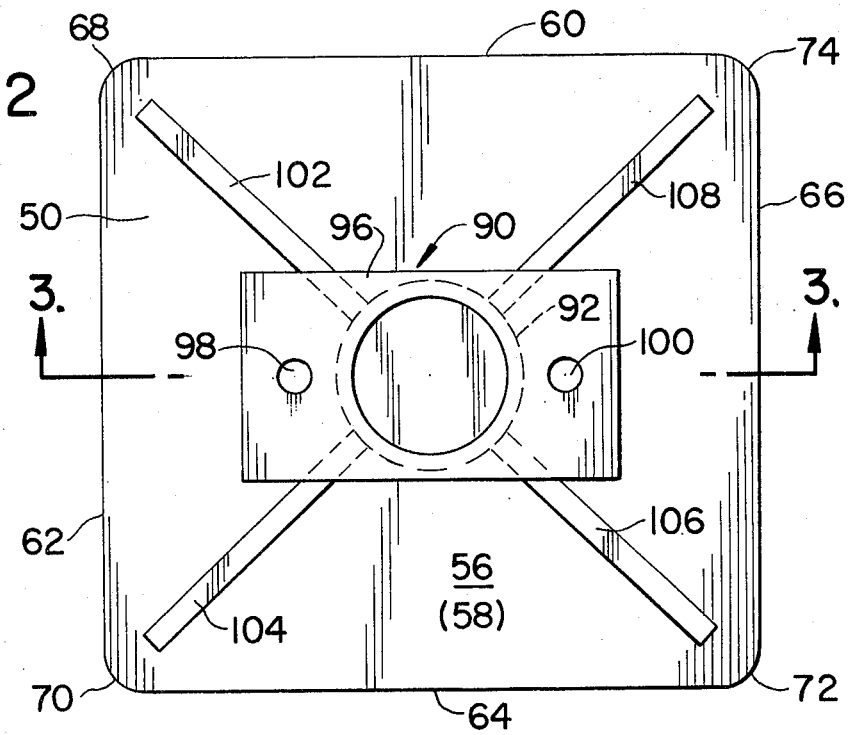
FIG. 2 is a plan view of the improved leveler door of the subject invention.
Figure 3:
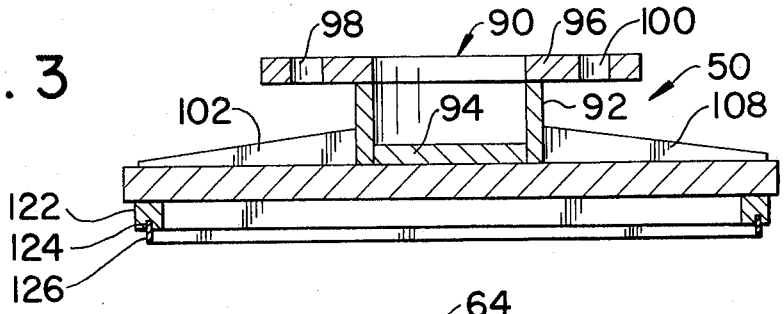
FIG. 3 is a cross-sectional view taken along lines 3—3 in FIG. 2.
Figure 4:
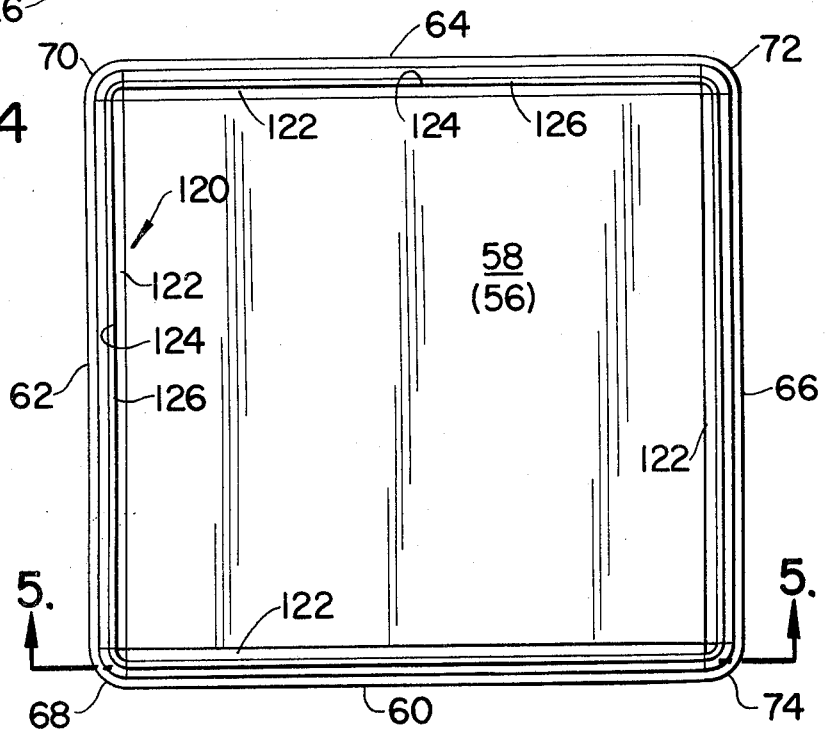
FIG. 4 is a bottom view of the improved leveler door shown in FIG. 2.

Substantially centrally disposed on outer face 56 as best shown in FIGS. 2 and 3 is a door mounting assembly generally designated 90. This mounting assembly is comprised of a hollow, slightly elongated cylindrical tube 92 having a base or backup plate 94 disposed at the bottom portion thereof against the surface of outer face 56 itself. Disposed at the outermost end of tube 92 is a generally rectangular mounting plate 96 having a pair of spaced apart mounting openings 98, 100 therein. In this arrangement, openings 98, 100 are used to rigidly mount door 50 to leveler door mounting assembly 52 by convenient means. A portion of biasing means 54, which comprises a spring biasing means in the preferred embodiment, is axially received in the hollow cylindrical tube 92 to act against base or backup plate 94.

Extending radially outward from adjacent tube 92 on outer surface 56 toward corner areas 68, 70, 72 and 74 are gusset members 102, 104, 106 and 108, respectively. These gussets gradually taper from a maximum heighth dimension adjacent tube 92 toward a minimum heighth dimension adjacent the corner areas. The gussets are rigidly affixed to outer face 56 by means of intermittent wells disposed longitudinally therealong on both sides thereof. The purpose for and function of these gussets will be described in greater detail hereinafter.

Figure 5:
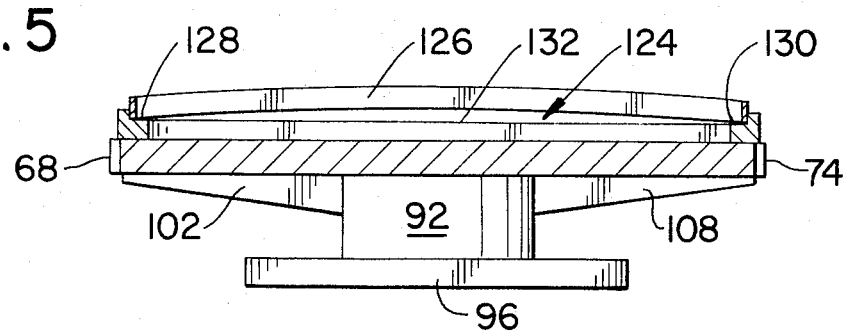
FIG. 5 is a cross-sectional view taken along lines 5—5 in FIG. 4.

Disposed on inner face 58 and extending outwardly therefrom is a sealing assembly generally designated 120. This assembly is comprised of retaining structure generally designated 122 which is disposed adjacent and generally follows the peripheral configuration of edges 60, 62, 64 and 66 continuously around the inner face. The retaining member may be conveniently fabricated and includes an outwardly facing continuous groove or slot area 124 therein. A continuous knife-like sealing edge 126 is received and rigidly retained in groove or slot 124 and it is this sealing edge which effects sealing contact between leveler door 50 and leveler door frame 36. In the preferred embodiment of the invention and as best shown in FIG. 5, the depth of groove 124 is less at points 128, 130 adjacent corner areas 68, 74 than the remainder thereof extending between these two corners. This same configuration of groove 124 and sealing edge 126 is also included between corner areas 68 to 70, 70 to 72 and 72 to 74. Preferably, the difference in depth of groove 124 at points 128, 130 is approximately .01'' less than the depth of the generally central area 132 between them. However, other dimensional relationships could be advantageously employed without departing from the intent and scope of the present invention.

Sealing edge 126 is positioned in continuous groove 124 and rigidly retained therein by convenient means at least at points 128, 130 to allow some inward and outward flexing of the edge between points 128, 130 for reason which will become apparent hereinafter. Once the sealing edge is positioned in groove 124, it is heated adjacent corner areas 68, 70, 72 and 74 to cause a slight outward bowing of the edge over the length thereof between the various points 128, 130. In FIG. 5, the configuration of groove 124 and the bow of seal 126 has been slightly exaggerated for ease of illustration.

In the preferred embodiment of the subject improved leveler door structure, the door 50 itself is constructed from cold rolled mild steel plate, preferably steel having a carbon content not exceeding 0.20%. By way of example, a thickness between outer and inner faces 56, 58 of ¾ inch has been found to be acceptable for most coke oven installations, although this dimension could be increased or decreased as deemed necessary for a particular installation or environment. In addition, the remainder of the components which overall comprise leveler door B are also preferably constructed from cold rolled steel stock. These components are then welded together and to door 50 where necessary to arrive at the final construction. Again, gussets 102, 104, 106 and 108 are retained in outer surface 56 by means of intermittent welds spaced longitudinally therealong. By way of further explanation in appreciating the preferred embodiment of the present invention, sealing edge 126 has a preferred thickness of 1/16 inch and extends outwardly from the outermost surface of retainer 122 approximately ¼ inch. The dimensions hereinabove given are merely for purposes of demonstrating those dimensions for the preferred embodiment which have proved successful on conventional coke ovens. These dimensions may be varied as deemed necessary or advisable under various circumstances without departing from the intent and scope of the present invention. Other types of mild steel and methods of fabricating could also be employed without departing from the intent and scope of the invention.

Figure 6:
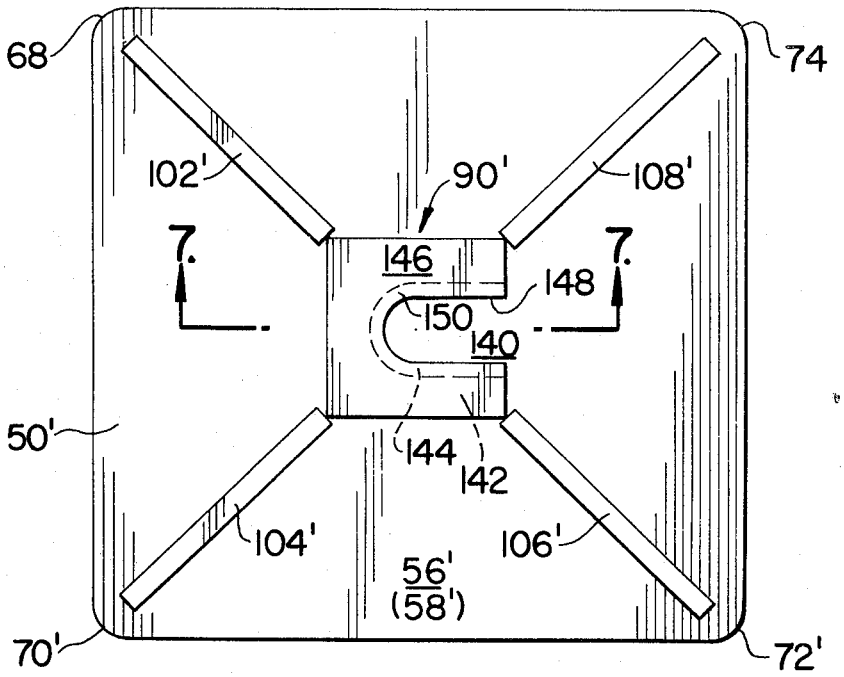
FIG. 6 is a plan view of an alternative leveler door structure which includes the concepts of the subject invention.
Figure 7:
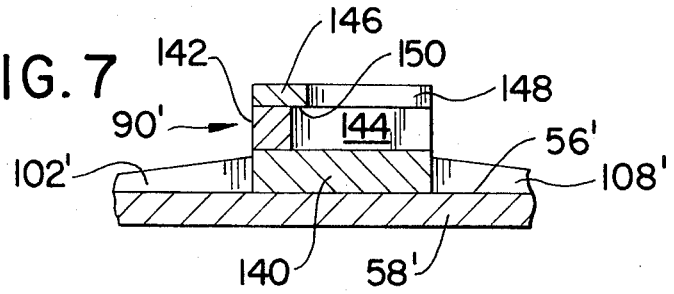
FIG. 7 is a partial cross-sectional view taken along lines 7—7 of FIG. 6; and, FIG. 8 is a partial cross-sectional view showing an alternative arrangement for the door sealing assembly.

FIGS. 6 and 7 show an alternative mounting assembly 90' which may also be used for the improved leveler door. In this alternative arrangement and for ease of illustration, like numerals with the addition of a primed (') suffix are employed to identify like components and new numerals are employed to identify new components. Accordingly, and in FIGS. 6 and 7, mounting assembly 90' is comprised of a generally square base or backup plate 140 generally centrally located and rigidly affixed to outer face 56'. Rigidly affixed to plate 140 is an outwardly extending mounting extension member 142 which includes an open ended slotted area 144 therein. Rigidly affixed to member 142 is an outer mounting plate 146 which includes a slot area 148 in general alignment with slot area 144. As will be noted, however, slot area 144 has a larger dimension than slot area 148 so that a flange-like area 150 or T-slot is created at the joint between mounting extension 142 and mounting plate 146. Slotted areas 144, 148 are such to facilitate rigid mounting of the leveler door to leveler door mounting assembly 52 with biasing means 54 acting thereagainst as described hereinabove with reference to the preferred embodiment specifically disclosed in FIGS. 2, 3, 4 and 5. In this alternative arrangement, gussets 102', 104', 106' and 108' extend outwardly from the corners of base plate 140 toward the corner areas 68', 70', 72' and 74'. The remainder of the embodiment shown in FIGS. 6 and 7 and its method of assembly is substantially identical to that hereinabove described with reference to the preferred embodiment.

Figure 8:
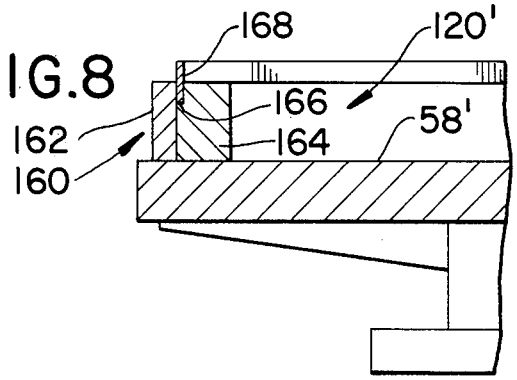

FIG. 8 shows an alternative arrangement for the sealing assembly. Here, again, like components will be identified by like numerals including a primed (') suffix and new components will be identified with new numerals for ease of illustration and appreciating the modification involved. Accordingly, sealing assembly 120' includes a retainer assembly 160 comprised of two separate members. These members are identified as an outer member 162 and an inner member 164. Inner member 164 includes a recessed or notched area 166 in the side thereof which abutts member 162. This arrangement provides a continuous groove or slot similar to area 124 in the preferred embodiment for receiving sealing edge 168. The components which comprise alternative sealing assembly 120' are again preferably constructed from cold rolled steel and welded to each other and to the inner face 58' of the leveler door.

Again referring to FIGS. 1 through 5, description will hereinafter be made to operation of the subject improved leveler door and its advantages over the prior cast iron doors. With the leveler door construction described in these FIGURES installed by means of leveler door mounting assembly 52 in the closed position to cover the associated opening 34, continuous sealing edge 126 engages the associated outwardly facing edges 38, 40, 42 and 44 of frame 36. Biasing means 54 exerts a continuous inwardly biasing force against mounting assembly 90 in the central portion of the leveler door.

In operation of the coke oven, certain portions of the oven, including a portion of the very large coke oven door, is not in contact with or effected by the highest temperatures, i.e., 2000° F and above generated in the oven during coking operation. The leveler opening 34 and inner face 58 of the leveler door are, however, in direct contact with the highest temperatures so generated. Thus, when cast iron leveler doors were employed and when the cast iron around the leveler opening itself would distort, the leveler door would not fit the distorted opening because the leveler door would not distort to the same configuration. Again, this was primarily due to the amount of surface area difference between oven door B and leveler door C as well as the temperature differentials acting on the two doors.

In the subject invention, however, the door is made from a cold rolled mild steel so that when the heat of the oven acts against the inner face 58, the door distorts or moves in the direction of pressure applied by biasing means 54 at generally the central area thereof. The construction of mounting assembly 90 is such that the focal point of the spring pressure is at that area. The preferred manner of fabrication for the door is, as noted above, welding and such a welded construction is solid as to all the mounting assembly components. The gussets 102, 104, 106 and 108, though, are welded intermittently along their outside edges in order to guarantee that the central focal point of the spring pressure remains in tact without distortion. The outer peripheral edges 60, 62, 64 and 66 can distort to fit an uneven surface generated around opening 34 in leveler door frame 36. The gradual tapering of the gussets from adjacent mounting assembly 90 to adjacent corner areas 68, 70, 72 and 74 is also effective in assuring that the central focal point remains in tact without distortion by giving greater strength to that area and a lesser amount of strength to the areas where it is not needed or those areas which will desirably distort. Further, the slight outward bow of sealing edge 126 between corner areas 68, 70, 72 and 74 assures relative positive initial contact between the sealing edge and the corresponding outwardly facing edges of leveler door frame 36. Upon closing of door 50 with the outwardly bowed areas of sealing edge 126 engaging frame 36, the bowed areas are forced into groove 124 in order that the remainder of the continuous sealing edge is closely received against the corresponding outwardly facing edges of frame 36 to thus ensure good sealing contact between the leveler door and door frame.

The design of the subject improved leveler door is related to the situation which is encountered in actual coking operations where it is necessary to eliminate any smoke or pollution emitted from the oven into the atmosphere or air being admitted into the coke oven itself. It has been found in practical application that within five to ten minutes following startup of a coking operation when temperatures within the oven have become substantially elevated the subject improved leveler door, because it is constructed from mild steel and subject to a strong biasing force from biasing means 54, will distort in a virtually customized manner so that sealing edge 126 will home into a sealing relationship with the outer facing edges of leveler door frame 36. Such a homing action stops smoke or pollution from escaping into the atmosphere as well as stopping the admission of air to the coking operation itself. The improved sealing further insures that a minimum amount of damage will occur to the coke oven door B itself.

The subject door may be readily made to fit any coke oven leveler opening by using the original door supporting brackets provided with the coke oven door. As a result, the improved leveler door is readily adapted to existing ovens on a replacement basis. The arrangement for sealing edge 126 as described above is also such that it is replaceable at a very low cost.

The invention has been described with reference to the preferred embodiment. Obviously, modifications and alterations will occur to others upon the reading and understanding of the specification. It is my intention to include all modifications and alterations insofar as they come within the scope of the appended claims or the equivalents thereof.

Having thus described my invention, I now claim:

1. In a coke oven of the type having a coke oven door providing access to the inside of said oven and wherein said oven door includes a leveler opening therein which may be selectively covered by a generally rectangular leveler door mounted in close spaced proximity thereto and movable between open and closed positions, the mounting of said leveler door including biasing means for exerting a continuous biasing force against the outside of said leveler door at least when said door is in said closed position, the improvement comprising: said leveler door being constructed from a mild steel plate having substantially flat inner and outer faces with said inner face covering said leveler opening when said leveler door is in said closed position, gusset members rigidly affixed to said outer face by means of intermittent welds spaced longitudinally therealong and positioned so as to extend radially outward from the central portion of said outer face toward each of the corners in the generally rectangular configuration thereof with said gusset members decreasing in height from said central portion toward said corners; means on said outer face for mounting said leveler door in operative communication with said biasing means; a knife-like sealing edge extending outwardly of said inner face from adjacent the outer peripheral edge thereof; and, sealing edge retaining means rigidly affixed to said inner face and interposed between said inner face and sealing edge for retaining said sealing edge in position, said retaining means including an outwardly facing seal receiving groove for receiving said sealing edge therein with said groove having a lesser depth at least adjacent the corner areas of said leveler door with said sealing edge affixed to said retaining means at least at said areas of lesser depth, the remainder of said sealing edge between said areas of lesser depth being spaced outwardly from the bottom of said seal receiving groove.

2. The improvement as defined in claim 1 wherein said outer face includes a backup plate disposed on the central portion thereof and rigidly affixed thereto, said backup plate adapted to be engaged by said biasing means.

3. The improvement as defined in claim 2 wherein said biasing means comprises a spring biasing means and said leveler door includes means protruding outwardly from said backup plate for capturing at least a portion of said spring biasing means.

4. The improvement as defined in claim 3 wherein said spring biasing means comprises a coil spring and said capturing means comprises a generally elongated cylindrical spring receiving member dimensioned to receive at least a portion of the length of said coil spring, said leveler door further including a door mounting plate adjacent the outermost end of said cylindrical receiving member.

5. The improvement as defined in claim 3 wherein said capturing means includes a T-slot extending partially therethrough in a plane generally parallel to the plane of said outer face for receiving said spring biasing means, said capturing means further including a door mounting area adjacent the outermost end thereof.

6. The improvement as defined in claim 1 wherein said sealing edge is bowed outwardly from said retaining means between said corner areas of said rectangular door configuration.

7. The improvement as defined in claim 1 wherein said seal retaining means is comprised of separate inner and outer members disposed in a side by side relationship on said inner face with said seal receiving groove included between said members.

8. In a coke oven of the type having a coke oven door providing access to the inside of said oven and wherein said oven door includes a leveler opening therein which may be selectively covered by generally rectangular leveler door mounted in close spaced proximity thereto and movable between open and closed positions, the improvement comprising:

said leveler door being constructed from a mild steel plate having substantially flat inner and outer faces with said inner face covering said leveler door opening when said leveler door is in said closed position; means on said inner face for sealing about said leveler opening when said leveler door is in said closed position, said sealing means extending generally peripherally around said inner face adjacent the outer peripheral edge thereof and comprising a knife-like sealing edge extending outwardly of said inner face; and, sealing edge retaining means affixed to said inner face and including a receiving groove in the outer face thereof for receiving said sealing edge therein, said groove having a lesser depth at least adjacent the corner areas of said leveler door with said sealing edge affixed to said retaining means at least at said areas of lesser depth.

9. The improvement as defined in claim 8 wherein the remainder of said seal between said areas of lesser depth is spaced outwardly of said seal receiving groove.

10. The improvement as defined in claim 8 wherein said seal is bowed outwardly from said retaining means between said corner areas of said rectangular door configuration.

11. The improvement as defined in claim 8 wherein said retaining means comprises separate inner and outer members disposed in a side by side relationship with said seal receiving groove included between said members.

* * * * *